US005222885A

United States Patent [19]

Cooksey

[11] Patent Number: 5,222,885

[45] Date of Patent: Jun. 29, 1993

[54] HORIZONTAL ROTARY COMPRESSOR OILING SYSTEM

[75] Inventor: Edward A. Cooksey, Adrian, Mich.

[73] Assignee: Tecumseh Products Company, Tecumseh, Mich.

[21] Appl. No.: 881,774

[22] Filed: May 12, 1992

[51] Int. Cl.[5] ..... F04C 29/02

[52] U.S. Cl. ..... 418/96; 418/98; 418/94

[58] Field of Search ..... 418/96, 98, 94; 184/6-16

[56] References Cited

U.S. PATENT DOCUMENTS

| | | | |
|---|---|---|---|
| 2,038,131 | 4/1936 | Richard . | |
| 2,545,600 | 3/1951 | Berry . | |
| 4,342,547 | 8/1982 | Yamada | 418/84 |
| 4,472,121 | 9/1984 | Tanaka | 418/63 |
| 4,518,330 | 5/1985 | Asami | 418/63 |
| 4,568,253 | 2/1986 | Wood | 417/372 |
| 4,645,429 | 2/1987 | Asami | 417/312 |
| 4,759,698 | 7/1988 | Nissen | 418/94 X |
| 4,781,542 | 11/1988 | Ozu et al. | 418/88 |
| 4,898,521 | 2/1990 | Sakurai | 418/96 |
| 5,012,896 | 5/1991 | DaCosta | 418/96 |

FOREIGN PATENT DOCUMENTS

| | | | |
|---|---|---|---|
| 1182594 | 7/1987 | Japan | 418/94 |

*Primary Examiner*—Richard E. Gluck
*Attorney, Agent, or Firm*—Baker & Daniels

[57] ABSTRACT

A compressor oiling system for a horizontal rotary compressor including a pressure plate defining a motor chamber and compressor unit chamber within the compressor each having an oil sump. An opening in the pressure plate allows oil pressurized by discharge pressure from the compressor to pass through an oil pickup passageway leading from the sump portion of the compressor unit chamber to the outboard bearing of the actual compressor unit. During compressor operation, discharge gases create a pressure differential across the pressure plate allowing the oil level to raise within the compressor unit chamber to the level of the crankshaft thereby lubricating the crankshaft bearings.

4 Claims, 2 Drawing Sheets

HORIZONTAL ROTARY COMPRESSOR OILING SYSTEM

BACKGROUND OF THE INVENTION

This invention pertains to hermetic rotary compressors for compressing refrigerant in refrigeration systems such as air conditioners, refrigerators, and the like. In particular, the invention relates to providing lubrication oil to bearing surfaces of the rotary compressor.

In general, prior art horizontal hermetic rotary compressors comprise a housing which is hermetically sealed. Located within the housing are an electric motor and a compressor mechanism. The electric motor is connected to a horizontal crankshaft which has an eccentric portion thereon. The eccentric portion of the crankshaft is located within a bore of the compressor cylinder. A roller located within the bore is mounted on the eccentric portion of the crankshaft and is driven thereby. The roller cooperates with a sliding vane to compress refrigerant within the bore of the cylinder.

Rotary hermetic compressors of the type herein disclosed generally have a pressurized or high side sealed housing. The compressor is connected into a refrigeration circuit by means of suction and discharge tubes. In prior art compressors, the motor stator has been secured to the interior wall of the housing by shrink fitting and the compressor cylinder is generally welded to the housing. A motor rotor is journalled in a bearing and drives the crankshaft. The suction tube extends through the housing and is sealingly connected thereto. The end of the suction tube which extends into the housing is connected to the cylinder and conducts low pressure refrigerant directly to the cylinder bore for compression therein. The connection of the suction tube to the cylinder is usually made by press fitting the tube into an aperture in the cylinder wall.

It is necessary to supply lubricating oil to the rotating and sliding parts between the rotor shaft and its bearings. It has been a conventional practice to forcibly supply lubricating oil to the parts requiring lubrication by pumping oil up from an oil sump at the bottom of the sealed housing by means of an oil supply pump.

A prior art compressor, as shown in U.S. Pat. No. 4,472,121, teaches how lubricating oil is pumped through a central lubrication bore from a lubricant feed tube which is opened at one end within a lubricant oil pool. The feed tube is intermittently subjected to refrigerant gas discharged from the compression unit. This type of compressor includes excess parts as compared to the invention described herein.

Another prior art horizontal compressor, U.S. Pat. No. 4,781,542, discloses a divider that separates the motor and compressor unit portions of the compressor while discharge pressure is communicated through the crankshaft into the motor cavity to lower the oil sump level in the motor chamber. The discharge gases are then passed through the divider to the compressor unit portion permitting a higher oil sump level due to a pressure differential across the partition. In this type of prior art compressor, it is impossible to achieve direct oil lubrication of the outer bearing and other rotating parts from the oil sump because of a cover separating the outboard bearing and discharge compressor port.

SUMMARY OF THE INVENTION

The present invention provides an improved compressor oiling system capable of supplying lubricating oil directly to the outboard bearing without the need for an oil pump.

Generally, the invention provides an oiling system for use in a horizontal rotary compressor. A pressure plate divides or partitions the compressor into a motor chamber, containing a motor, and a compressor chamber, containing a compressor mechanism. The motor and compressor mechanism are connected by means of a crankshaft while an oil sump is disposed within the bottom of both chambers communicating through an opening or passageway in the pressure plate below the oil level of the oil sump.

An oil pickup passageway is provided, in the compressor chamber, from the sump portion adjacent to the pressure plate opening up to the compressor outboard bearing and crankshaft. The compressor mechanism ejects refrigerant at discharge pressure through or around the partition to pressurize the motor cavity, thereby lowering the oil sump level in the motor cavity and at the same time raising the oil sump level within the compressor cavity up to the level of the oil pickup passageway. Oil is then drawn up the passageway by the pumping action due to movement of a crankshaft oil passageway.

In one form of the invention, a cap is attached over the outboard bearing and crankshaft connecting with the oil pickup passageway leading from the oil sump. Compressor discharge gases lower the oil level in the motor chamber while raising the oil level within the compressor cavity, thereby helping transport oil up the oil passageway into the cap, contacting with the outboard bearing and lubricating the compressor mechanism.

An advantage of the rotary compressor of the present invention is that of eliminating the necessity for an oil pump to maintain an adequate supply of oil to the bearing surfaces of the compressor.

A further advantage of the rotary compressor of the present invention is that of creating a torturous path for the refrigerant to take thereby removing oil droplets from the refrigeration gases.

Another advantage of the compressor is that the oil cap over the outboard bearing can act as an oil reservoir. This reservoir operates at compressor startup to ensure oil lubrication.

The invention, in one form thereof, provides a horizontal rotary compressor including a housing having an oil sump with a normal or nominal oil level. A partition means such as a pressure plate is disposed within the housing defining a motor chamber and a compressor chamber. The partition means defines an opening submerged in the oil sump through which the two chambers may communicate. An electric motor is contained in the motor chamber while a rotary compressor unit is contained in the compressor unit chamber. The compression unit has a cylinder block with a rotor disposed therein with a crankshaft rotatably disposed within the cylinder block, connecting between the rotor and the electric motor through the partition means. An outboard bearing is attached to an axial end of the cylinder block to support the crankshaft. The compression unit further has a discharge port discharging into the motor chamber through the partition means.

In one aspect of the previously described form of the invention, the horizontal rotary compressor includes an oiling system comprising a means for defining an oil pickup passageway leading from the oil sump in the compressor unit chamber to the outboard bearing, whereby during compressor operation discharge gases from the compression unit flow into the motor chamber lowering the oil level in the oil sump in the motor chamber and correspondingly raising the oil level in the oil sump in the compressor unit chamber thereby transporting oil through the oil passageway and into contact with the outboard bearing.

In accord with another aspect of the invention, the oil pickup passageway may include an oil pickup tube having an end attached to an oil cap fitting over the outboard bearing and an unattached end submerged in oil in the compressor chamber. During compressor operation, discharge gases from the compression unit urge oil through the opening in the partition means, transporting oil through the oil tube, into the oil cap and into contact with the outboard bearing.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
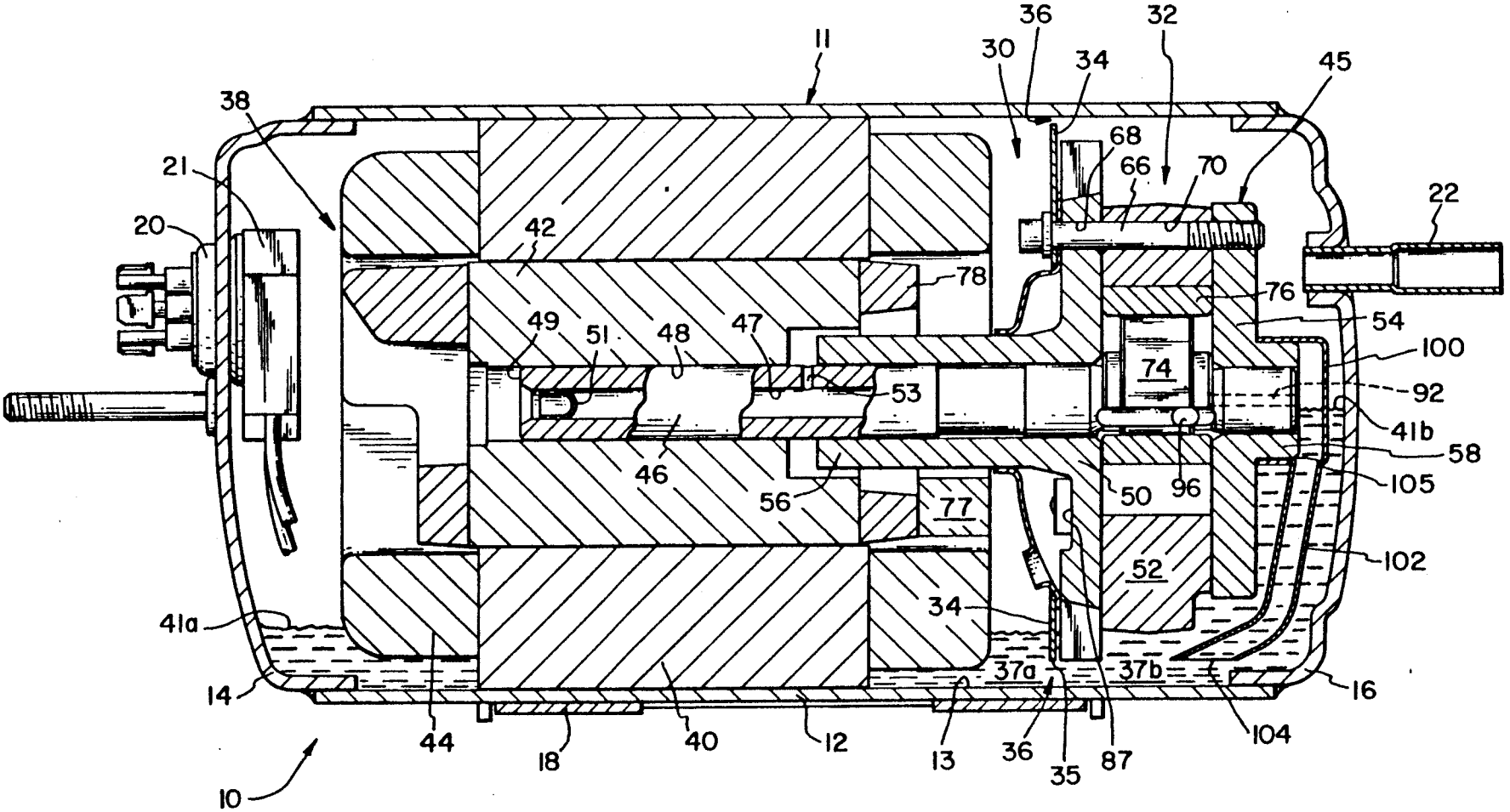
FIG. 1 is a longitudinal sectional view of the compressor of the present invention in operation.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Referring to FIG. 1 there is shown the horizontal compressor 10. A casing or housing 11 is shown having a cylindrical portion 12 and end portions 14 and 16, respectively. A flange 18 is shown welded to cylindrical portion 12 of compressor 10. The flange 18 is used for mounting the compressor to a refrigeration apparatus such as an air conditioner or refrigerator.

Figure 2:
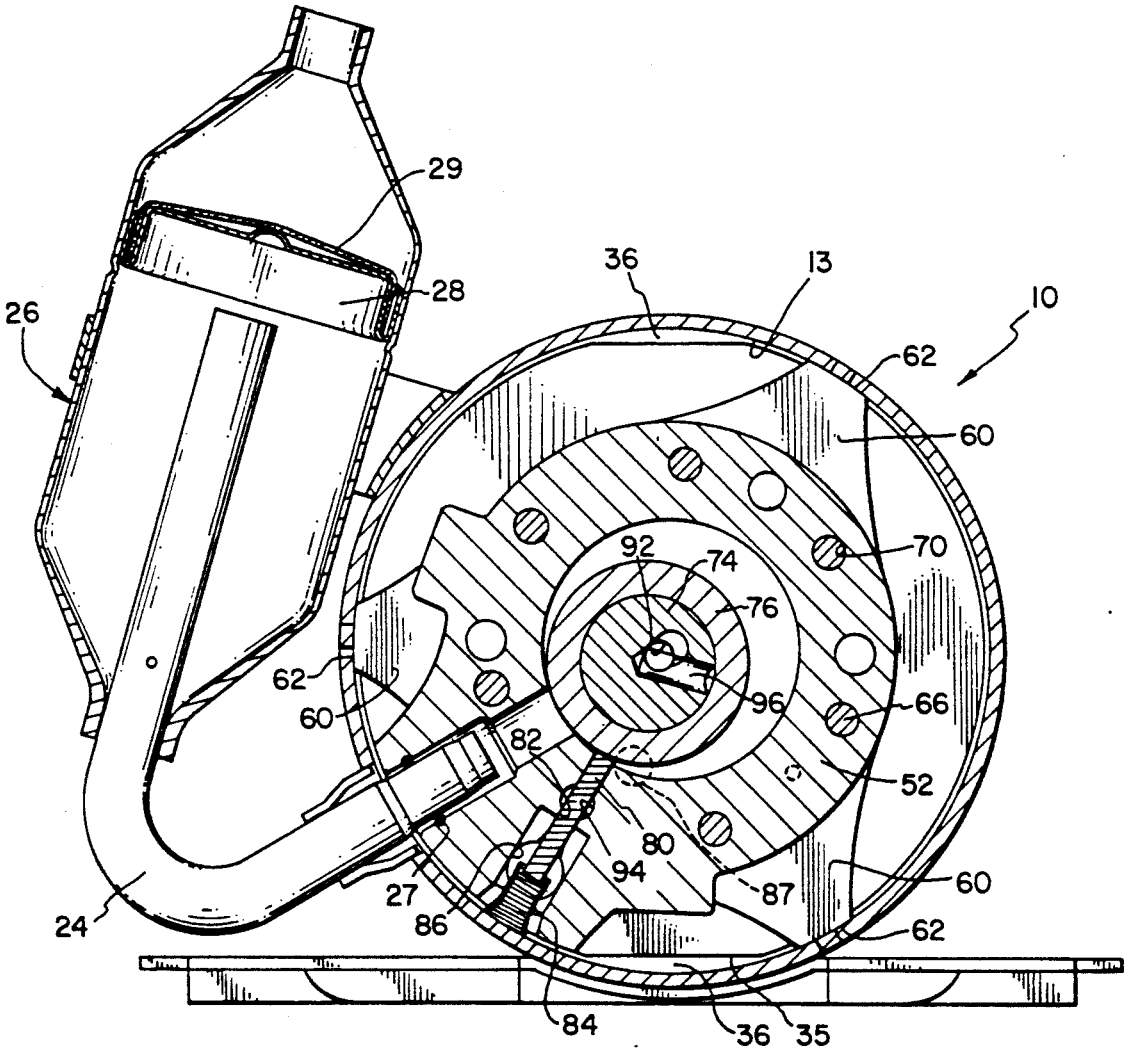
FIG. 2 is a end sectional view of the compressor of the present invention.

A hermetic terminal 20 and cluster block 21 are provided for making electrical connections from a supply of electric power to a compressor motor 38 located within housing 11. A discharge tube 22 extends through end portion 16 and into the interior of housing 12 as shown. Tube 22 is sealingly connected to housing 11 as by soldering or brazing. A suction tube 24 extends into the interior of compressor housing 11 as shown in FIG. 2. Suction tube 24 connects to cylinder block 52 by an 0-ring 27 and by welding to housing 11. An outer end of suction tube 24 is connected to an accumulator 26 which has support plates 28 disposed therein for supporting a filtering mesh 29.

Compressor 10 is separated into substantially two chambers, a motor chamber 30 and a compressor unit chamber 32 by a partition means such as pressure plate 34 disposed within housing 11. Pressure plate 34 also separates an oil sump located in housing 11 into oil sumps **37*a* and 37*b* . As shown in FIG. 2, plate 34** is substantially circular.

Pressure plate 34 defines at least one opening 36 communicating between chambers 30 and 32. This opening 36 is created by a clearance space between inner wall 13 of portion 12 and the outer diameter of plate 34. The clearance may be further enlarged by a flat 35 or other similar means cut into the outer diameter of plate 34 (FIG. 2). Oil sumps **37*a* and 37*b* are located in the bottom of chambers 30 and 32 respectively, communicating through opening 36 along the lower side of cylindrical portion 12. Each oil sump 37*a* and 37*b* includes an oil level 41*a* and 41*b* respectively. Opening 36 is disposed between oil sumps 37*a* and 37*b*** .

The opening 36 permits a limited amount of refrigerant from chamber 30 through to chamber 32 while creating a tortuous path for the refrigerant. This path helps to remove entrained oil within the refrigerant. Opening 36 also equalizes compressor pressures between motor chamber 30 and compressor unit chamber 32 during compressor shut down.

An electric motor 38 is disposed within motor chamber 30 and includes a stator 40 and a rotor 42. Electric motor 38 is an induction type motor having a squirrel cage rotor 42. Windings 44 provide the rotating magnetic field for inducing rotational movement of rotor 42. The stator 40 is secured by an interference fit to the interior wall of housing 11 as by shrink fitting. There is an oil passage between the outer diameter of the motor 38 and housing 11 to permit movement of oil past motor 38 for cooling purposes.

Compressor unit 45 is disposed within chamber 32. A crankshaft 46 is secured in the hollow interior aperture 48 of rotor 42. Crankshaft 46, having an interior oil passageway 47, extends axially through compressor unit 45, main bearing 50, and cylinder block 52 into an outboard bearing 54. On one end 49 of crankshaft 46, interior oil passageway 47 is sealed by a plug 51. The crankshaft 46 is journalled for rotation within bearings 50 and 54. Main bearing 50 includes three flanges 60 thereon for securing bearing 50 to housing 11 at points 62 such as by welding (FIG. 2).

Cylinder 52 and outboard bearing 54 are secured to main bearing 50 by means of six bolts 66 as best illustrated in FIG. 2. Bolts 66 extend through holes 68 in main bearing 50 and holes 70 in cylinder block 52 and are threaded into outboard bearing 54 (FIG. 1).

As illustrated in FIG. 2, crankshaft 46 includes an eccentric portion 74 thereon revolving eccentrically around the axis of crankshaft 46. A cylindrical roller member 76 surrounds eccentric 74 and rolls around eccentric portion 74 within cylinder block 52. As shown in FIG. 1, a counterweight 77 for counterbalancing the eccentric 74 is secured to end ring 78 of motor rotor 42, such as by riveting. A rectangular sliding vane 80 is received in a vane slot 82 (FIG. 2). Vane slot 82 is located in cylinder block 52. A spring 84 biases an end of vane 80 against roller 76 for continuous engagement therewith. Spring 84 is received in a spring pocket 86 machined into the wall of cylinder block 52 adjacent vane slot 82. A discharge port 87 permits passage of compressed refrigerant from cylinder 52 into motor chamber 30.

An oil passage 94 is provided adjacent vane slot 82 for lubricating vane 80. A radial oil lubrication hole 96 is provided in eccentric 74 of shaft 46 for lubricating roller 76. The hole 96 communicates with bore 92 in shaft 46 and receives oil therefrom.

The oiling system of the present invention comprises, in addition to pressure plate 34, a bearing cap 100 attached over outboard bearing 54 connected to an oil pick-up passageway or tube 102. Oil pick-up tube 102 includes one end 104 disposed within oil sump **37*b* and the other end 105 opening into bearing car 100. Tube opening 104 is adjacent pressure plate opening 36, between motor chamber 30 and compressor chamber 32. Oil pick-up tube 102 can conduct oil from oil sump 37***b* through end 104 into bearing cap and into contact with crankshaft 46 and outboard bearing 54. Because of the improvement to oil flow through the compressor, the oil flow must be controlled or restrained. To prevent excessive oil flow, it is necessary to plug the motor end 49 of shaft 46 with a plug 51 and place a vent 53 at the end of the main bearing 50 in the outer diameter of shaft 46.

In operation, as power is applied to electric motor 38, compressor unit 45 compresses refrigerant due to the operation of rotor 76 and vane 80 within cylinder 52. Compressed refrigerant passes through discharge port 87 into motor chamber 30. This creates a pressure differential across plate 34, since compressor chamber 32 is not pressurized by discharge gases at startup.

High pressure within motor chamber 30 applies pressure to the oil in sump 37*a* located within motor chamber 30 and this forces oil past opening 36 into compressor unit chamber 32. This transfer of oil lowers the sump oil level 41*a* within motor chamber 30 and raises the sump oil level 41*b* within compressor unit chamber 32. The movement of oil bore 92 during compressor operation, causes oil to be pumped up through oil passageway 102. Oil level 41*b* within the compressor chamber 32 will preferably rise to a level to cover the open end 104 of oil pickup tube. Additionally, the oil level 41*b* may rise to a level equal to the center line of the crankshaft 46.

The oil transported through pressure plate opening 36 also flows into oil pick-up tube 102. Oil is transported up oil pickup tube 102 into bearing cap 100 by the oil level 41*b* of oil in sump 37*b* and by pumping caused by the movement of oil bore 92. This oil is now in contact with outer bearing 54 and passes through bore 92 in crankshaft 46 thereby communicating with oil passage 96, vane 82 and rotor 76. Discharge gases from compressor unit 45 make their way past pressure plate 34, through opening 36 into compressor unit chamber 32, and then exit compressor 10 through discharge tube 22 continuing on to a refrigeration apparatus (not shown).

This oiling system eliminates the need for a separate oil pump mechanism. The path of refrigerant past pressure plate 34 and through opening 36, creates a tortuous path for suspended oil droplets within the compressed refrigeration gases that helps to remove oil droplets from the refrigerant.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A horizontal rotary compressor comprising:

a housing having an oil sump including a nominal oil level;

a partition means disposed within said housing, said partition means defining a motor chamber and a compressor unit chamber, said partition means defining an opening partially submerged in said oil sump, said opening created by a small gap between said partition means and said housing, said opening further defining a passageway between said chambers creating a tortuous path for refrigerant thereby removing entrained oil, said chambers communicating oil through the submerged portion said opening;

an electric motor disposed within said motor chamber;

a rotary compression unit disposed within said compressor unit chamber, said unit having a cylinder block with a rotor disposed therein, a crankshaft rotatably disposed within said cylinder block and connecting between said rotor and said motor through said partition means, and an outboard bearing attached to a first axial end of said cylinder block and supporting said crankshaft, said compression unit further having a discharge port on a second axial end discharging into said motor chamber through said partition means; and an oiling system comprising a means for defining an oil pick-up passageway leading from said oil sump in said compressor unit chamber to said outboard bearing, whereby during compressor operation, discharge gases from said compression unit flow into said motor chamber lowering the oil level in the oil sump in said motor chamber and correspondingly thereby raising the oil level in the oil sump in said compressor unit chamber thereby transporting oil through said oil passageway and into contact with said outboard bearing.

2. The compressor of claim 1 in which said opening is enlarged by a flat on an outer diameter of said partition means.

3. The compressor of claim 1 in which said opening is created by between an outer diameter of said partition means and an inner diameter of said housing.

4. The compressor of claim 1 in which said partition means is substantially circular.

* * * * *